United States Patent [19]

Bedwell et al.

[11] Patent Number: 4,795,062

[45] Date of Patent: Jan. 3, 1989

[54] BAG-LIKE CONTAINER

[75] Inventors: Hubert A. Bedwell, Sycamore Township; Ronald C. Dreyer, Cheviot, both of Ohio

[73] Assignee: Fibre Glass-Evercoat Company, Inc., Cincinnati, Ohio

[21] Appl. No.: 91,079

[22] Filed: Aug. 31, 1987

Related U.S. Application Data

[63] Continuation-in-part of Ser. No. 903,970, Sep. 5, 1986, Pat. No. 4,722,457, and a continuation-in-part of Ser. No. 913,971, Oct. 1, 1986, Pat. No. 4,739,903.

[51] Int. Cl.[4] ..... B65D 47/10

[52] U.S. Cl. ..... 222/92; 222/541; 222/561

[58] Field of Search ..... 222/105, 106, 107, 92, 222/561, 559, 545, 541

[56] References Cited

U.S. PATENT DOCUMENTS

| | | | |
|---|---|---|---|
| 3,422,997 | 1/1969 | Anderson | 222/92 X |
| 3,696,977 | 10/1972 | Davenport et al. | 222/561 |
| 3,930,286 | 1/1976 | McGowen | 222/105 X |
| 4,257,535 | 3/1981 | Mellett | 222/92 |
| 4,331,266 | 5/1982 | Bond | 222/107 |
| 4,378,069 | 3/1983 | Franco | 222/541 X |
| 4,445,550 | 5/1984 | Davis et al. | 222/105 X |
| 4,449,649 | 5/1984 | Flannigan | 222/105 X |
| 4,601,410 | 7/1986 | Bond | 222/105 X |
| 4,637,531 | 1/1987 | Olsson | 222/559 |

FOREIGN PATENT DOCUMENTS

| | | | |
|---|---|---|---|
| 3445086 | 6/1986 | Fed. Rep. of Germany | 222/561 |

*Primary Examiner*—Joseph J. Rolla
*Assistant Examiner*—Nils E. Pedersen
*Attorney, Agent, or Firm*—James W. Pearce; Roy F. Schaeperklaus

[57] ABSTRACT

A bag-like container which comprises first and second flexible wall members. Edge portions of the flexible wall members are attached together, and a spout having an annular body and an outstanding annular flange at an end of the body is attached to one of the wall members. Slots in the annular body parallel to the annular flange and spaced therefrom support a slideably mounted closure plate member. A tongue is mounted on the closure plate member. The tongue moves in openings in opposed sides of the spout body between a closed position in which the tongue closes the spout body and an open position.

5 Claims, 5 Drawing Sheets

BAG-LIKE CONTAINER

BACKGROUND OF THE INVENTION

This invention relates to a bag-like container having flexible walls; similar bag-like containers are shown in our copending applications Ser. No. 06/903,970 filed Sept. 5, 1986 for Dispensing Device now U.S. Pat. No. 4,722,457 issued Feb. 2, 1988 and Ser. No. 06/913,971 filed Oct. 1, 1986 for Dispensing Case Assembly now U.S. Pat. No. 4,739,903 issued Apr. 26, 1988, each of which this application is a continuation-in-part.

BRIEF DESCRIPTION OF THE INVENTION

Briefly, this invention provides a bag-like container having flexible walls. A spout is mounted on one of the walls of the container. The container can be mounted in a support or case having a wall provided with an opening for receiving the spout. The spout is provided with guide slots for receiving a closure plate member. The closure plate member includes a tongue which moves with the closure plate member between a closed position, in which the tongue closes the spout, and an open position.

The above and other objects and features of the invention will be apparent to those skilled in the art to which this invention pertains from the following detailed description and the drawings, in which:

BRIEF DESCRIPTION OF THE DRAWINGS

In the following detailed description and the drawings, like reference characters indicate like parts.

DESCRIPTION OF PRESENTLY PREFERRED EMBODIMENT

Figure 1:
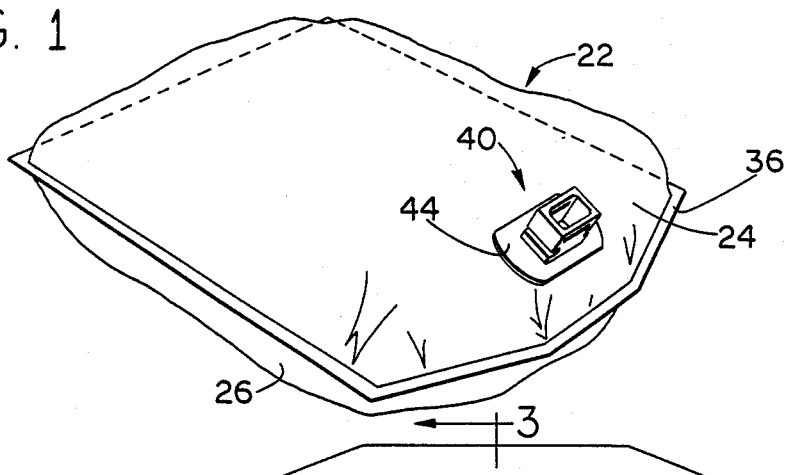
FIG. 1 is a perspective view of a container which is constructed in accordance with an embodiment of this invention.
Figure 2:
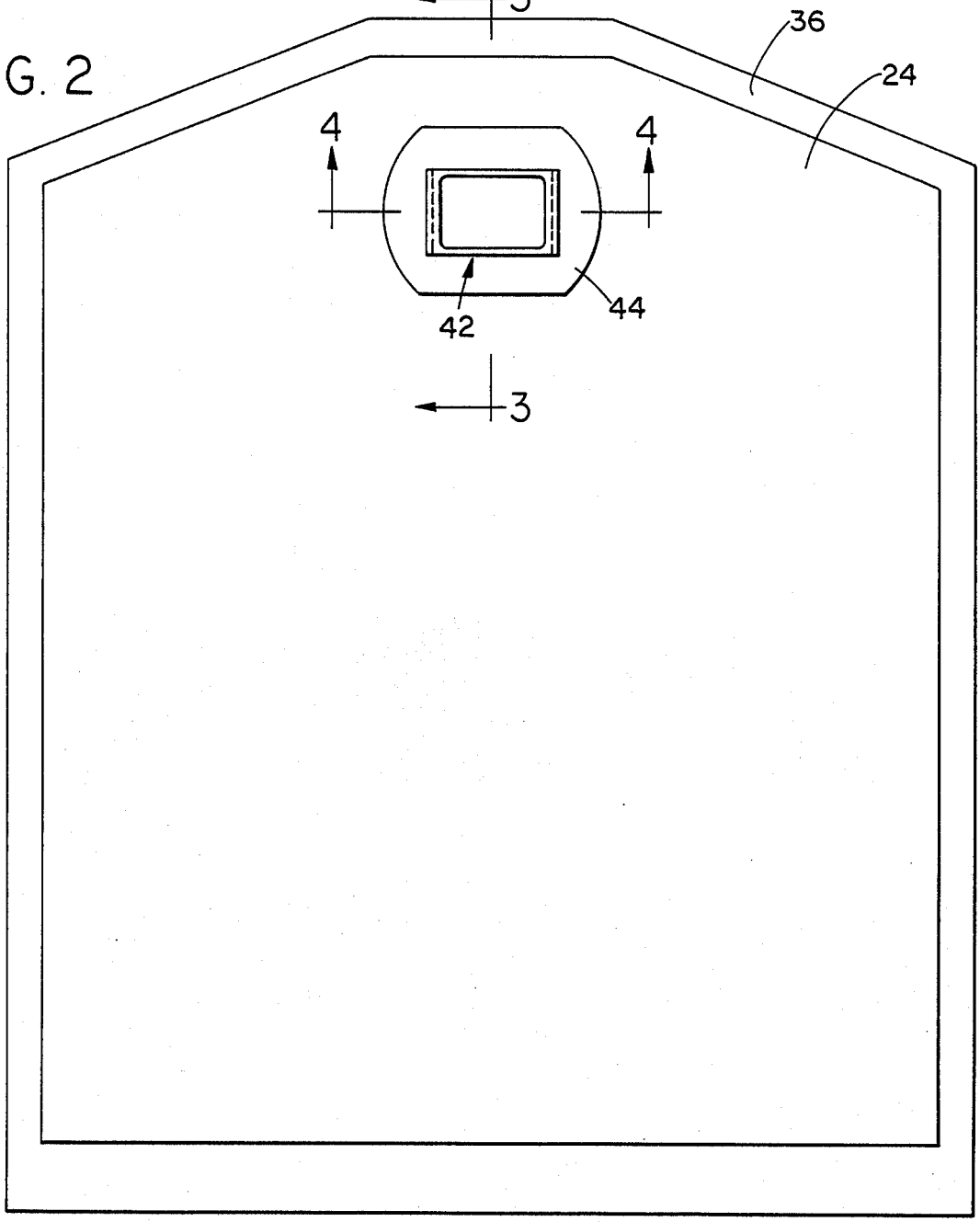
FIG. 2 is a plan view of the container shown in FIG. 1.
Figure 3:
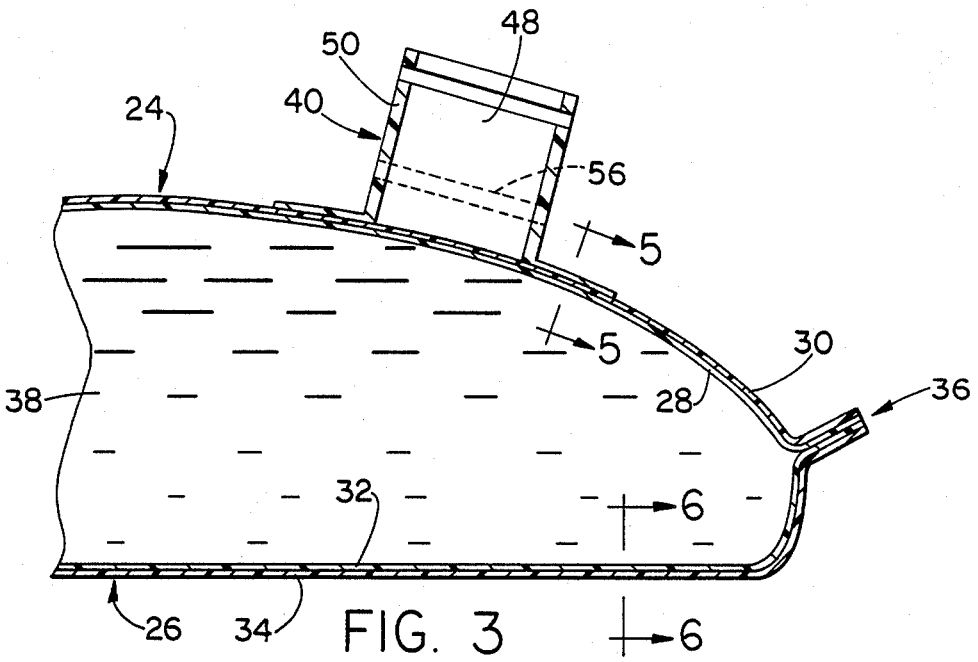
FIG. 3 is a fragmentary, somewhat schematic view in section taken on an enlarged scale on the line 3—3 in FIG. 2.
Figure 4:
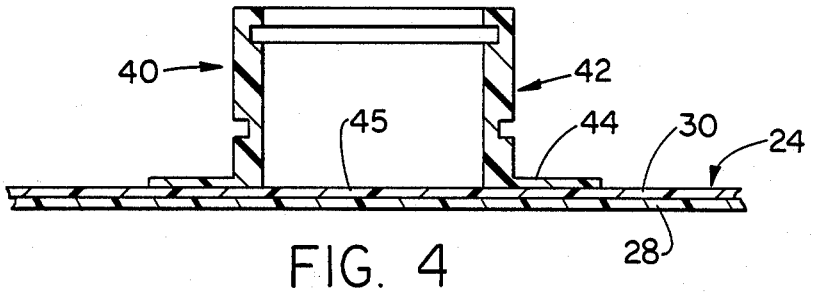
FIG. 4 is a fragmentary view in section taken on an enlarged scale generally on the line 4—4 in FIG. 2.
Figure 5:
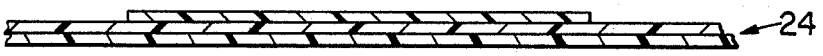
FIG. 5 is a view in section taken on an enlarged scale on the line 5—5 in FIG. 3.
Figure 6:
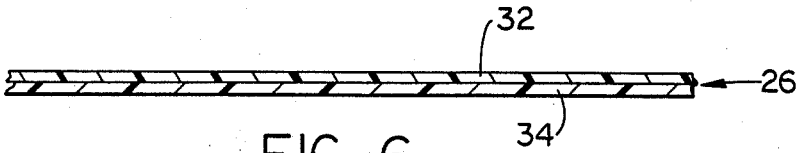
FIG. 6 is a view in section taken on an enlarged scale on the line 6—6 in FIG. 3.

In FIG. 1 is shown a bag-like container 22 which is constructed in accordance with an embodiment of this invention. The bag-like container 22 includes flexible walls 24 and 26, as shown in FIG. 3. The flexible wall 24 includes an inner ply 28 and an outer ply 30. The inner ply 28 and the outer ply 30 are firmly attached together in face-to-face relation. The flexible wall 26 includes an inner ply 32 and an outer ply 34. The inner ply 32 and the outer ply 34 are firmly attached together in face-to-face relation. Edge portions of the flexible walls 24 and 26 are fused together to form a sealing flange 36 between the walls 24 and 26. The container 22 is filled with plastic material 38 such as the type of material which is used to fill dents and the like in panels of a vehicle body (not shown).

A spout assembly 40 is mounted on the outer ply 30 of the wall 24. The spout assembly 40 includes a tubular body 42 and an outwardly extending annular flange 44. The flange 44 is firmly attached to the outer ply 30. A closure panel portion 45 of the wall 24 normally closes the spout assembly 40. The closure panel portion 45 can be cut away to form an opening and to permit discharge of the contents of the bag-like container 22 through the body 42 of the spout assembly 40.

The spout body 42 is of rectangular cross-section and includes side panels 46 and 48, an upper panel 50 and a lower panel 52. Upright track grooves 54 and 56 are formed in the opposed side panels 46 and 48, respectively, and extend parallel to the flange 44 and spaced therefrom. Slots or openings 58 and 60 are formed in the opposed upper panel 50 and the lower panel 52, respectively.

Figure 7:
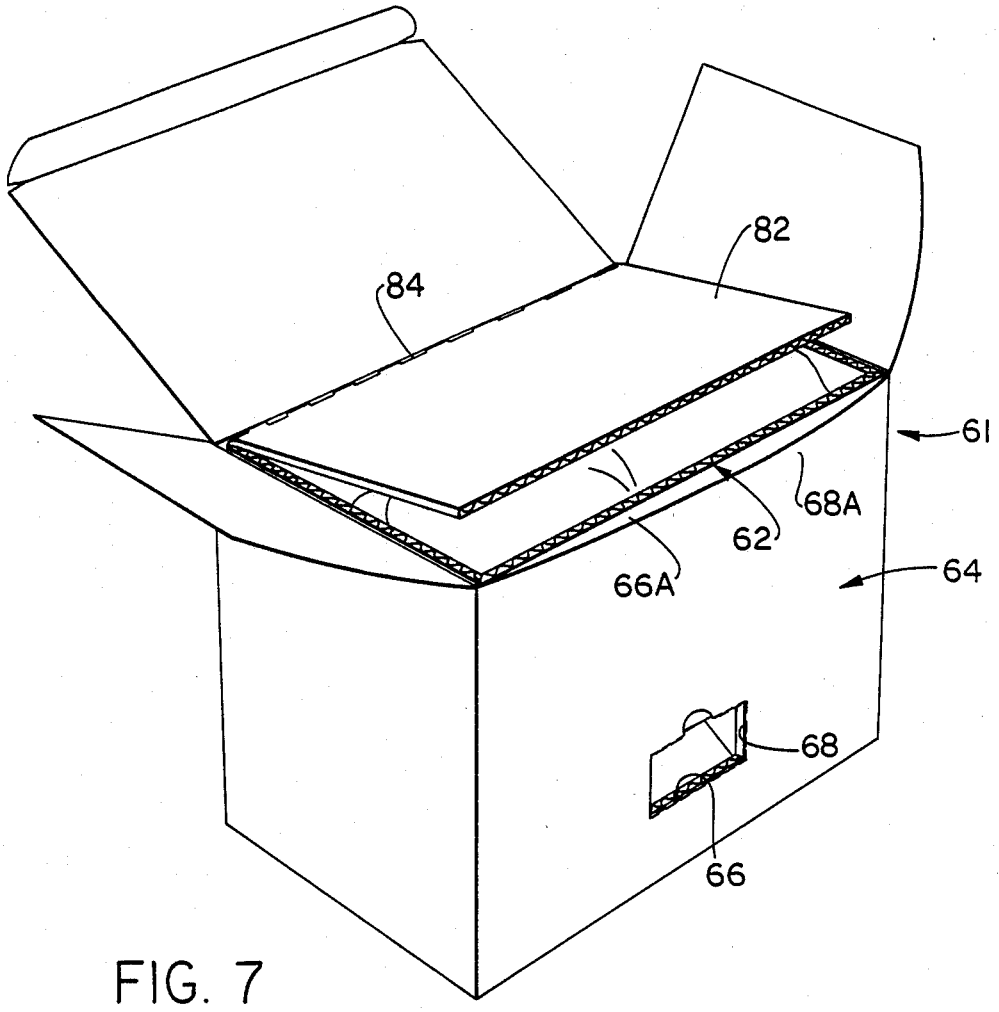
FIG. 7 is a perspective view of a case assembly with a container mounted therein, the spout being in withdrawn position.
Figure 8:
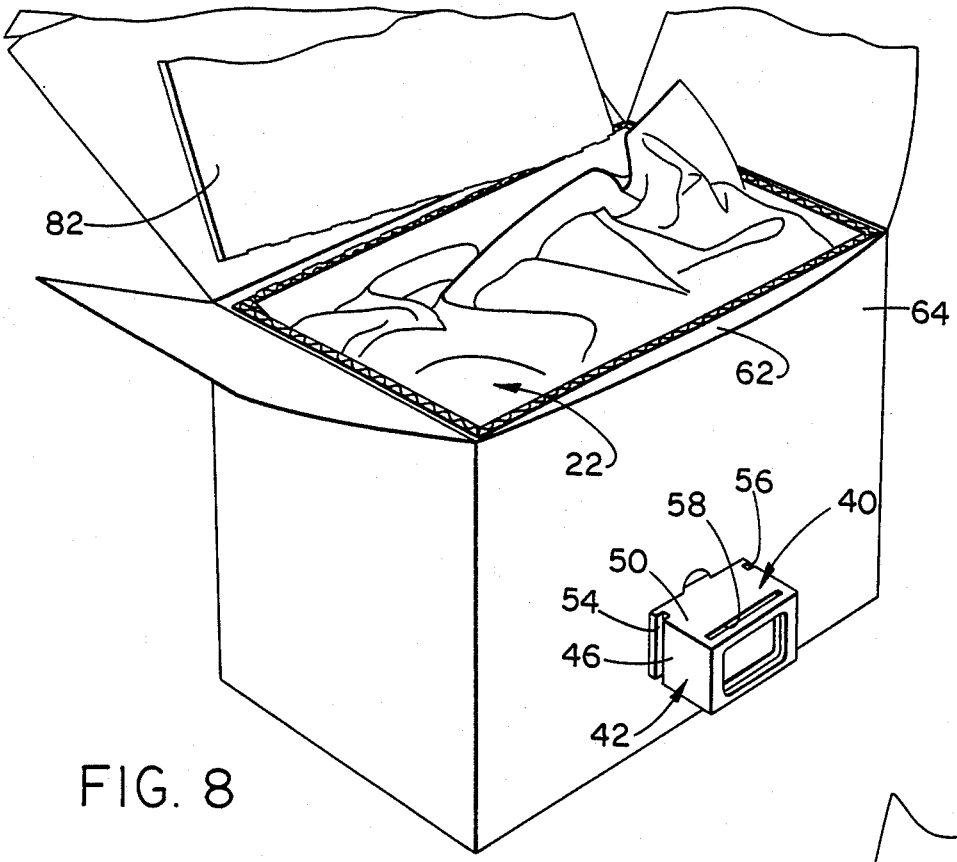
FIG. 8 is a perspective view of the case assembly with the container thereinside, the spout extending through walls of members of the case assembly.
Figure 10:
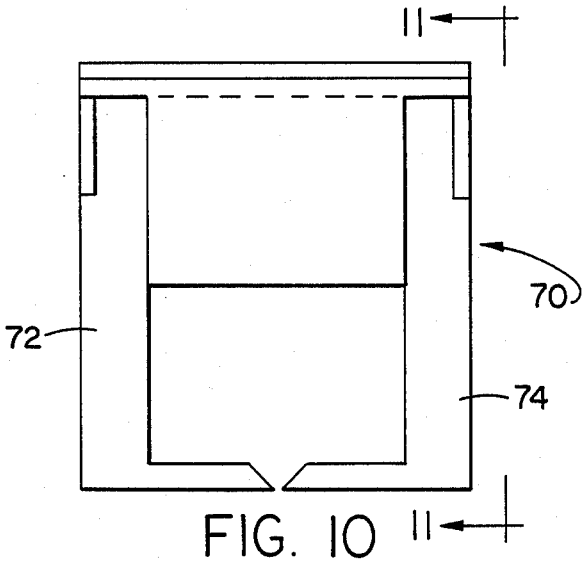
FIG. 10 is a view in side elevation of the closure plate member.
Figure 11:
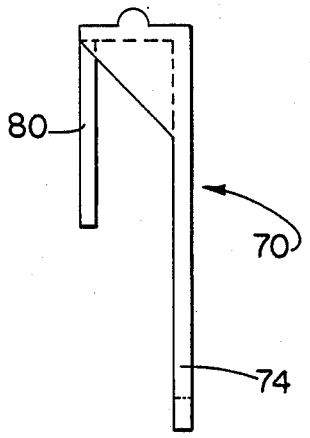
FIG. 11 is a view in end elevation of the closure plate member looking in the direction of the arrows 11—11 in FIG. 10.
Figure 12:
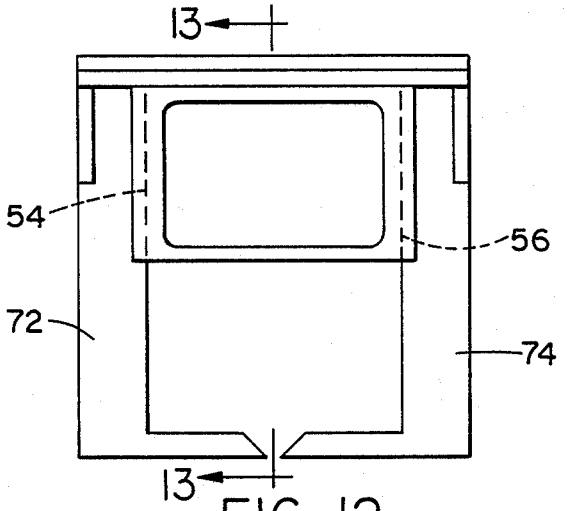
FIG. 12 is a view in side elevation of the closure plate member in association with the spout.
Figure 13:
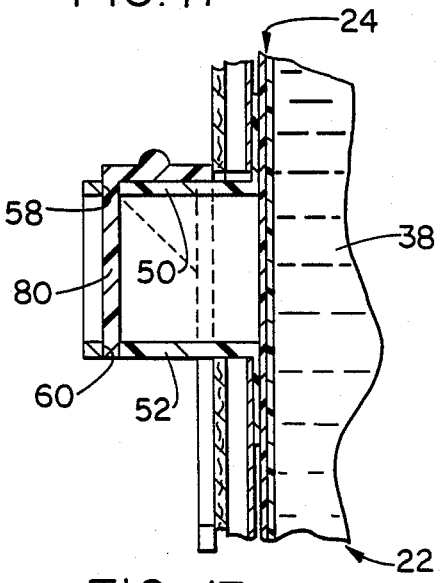
FIG. 13 is a view in section taken on the line 13—13 in FIG. 12, fragmentary parts of the container and of the case assembly being shown.
Figure 14:
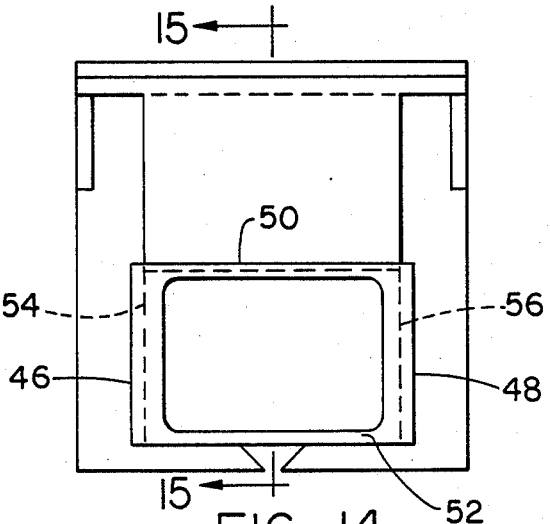
FIG. 14 is a view in front elevation of the closure plate and the spout removed from the case assembly, the closure plate member being shown in spout open position.
Figure 15:
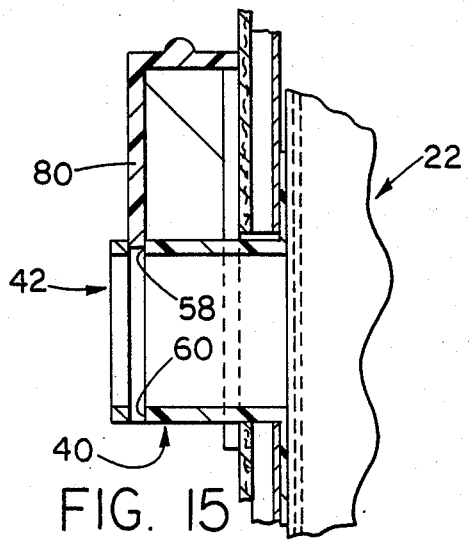
FIG. 15 is a view in section taken on the line 15—15 in FIG. 14, fragmentary details of the container and of case members being shown.

The bag-like container 22 can be mounted in a case assembly 61 (FIG. 7) which includes an inner case member 62 and an outer case member 64. The case members 62 and 64 are provided with openings 66 and 68 in wall members 66A and 68A, respectively, through which the body 42 of the spout assembly 40 can extend. The wall members 66A and 68A support the spout body 42. A closure bracket 70 (FIGS. 10 and 11) can be mounted on the spout body 42. The closure bracket 70 includes support arms 72 and 74 which slide in the upright track grooves 54 and 56. A tongue 80 of the closure bracket 70 can slide in the slots 58 and 60 in the upper panel 50 and the lower panel 52, respectively, and can move between a spout open position shown in FIG. 15 and a spout closed position shown in FIG. 13.

Figure 9:
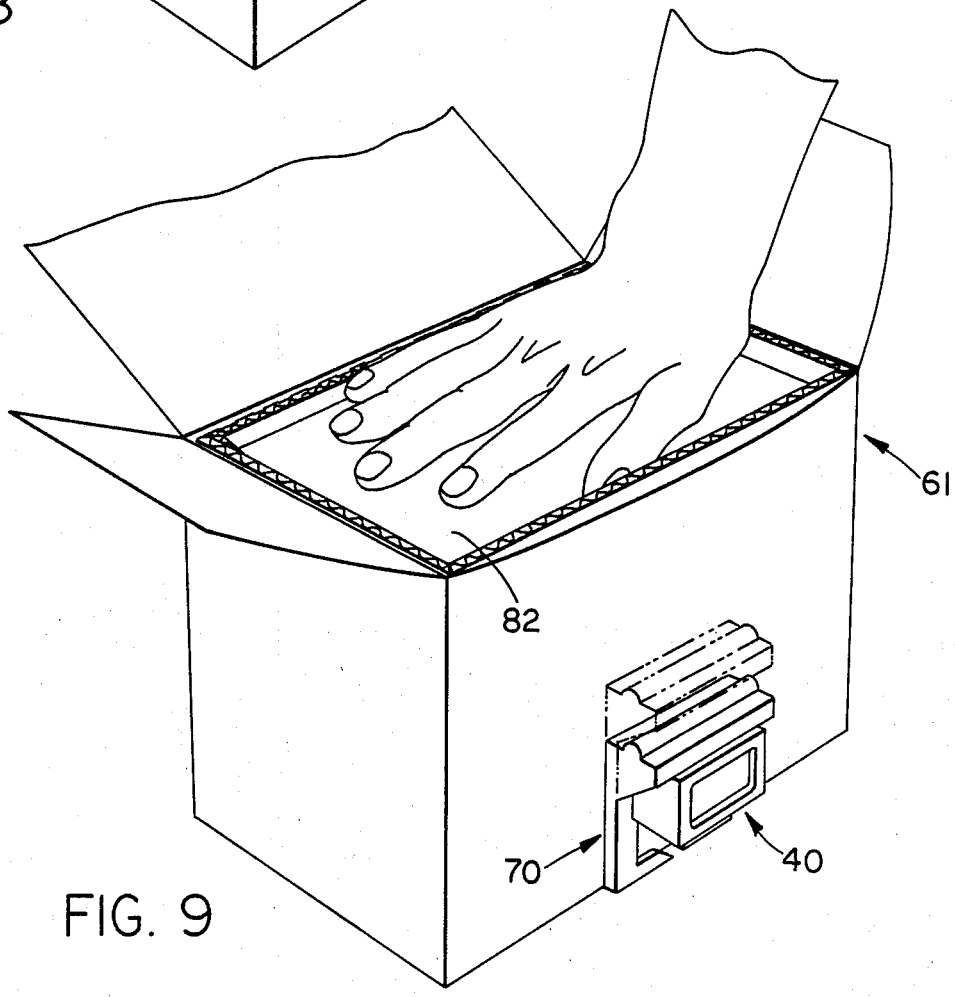
FIG. 9 is a perspective view of the case assembly with a plunger member thereof in operative position, the spout being in operative position, a closure plate member being shown in closed position in full lines and in open position in double-dot-dash lines.

When plastic material 38 is to be dispensed, a pressure panel 82, which is a portion of the inner case member 62, can be removed at perforations 84, and the spout body 42 can be directed through the openings 66 and 68 in the case members 62 and 64, respectively. The closure bracket 70 is mounted on the spout body 42 to hold the spout body 42 in position. The closure panel portion 45 of the wall 24 of the bag-like container 22 is cut away to permit discharge of contents of the bag-like container 22 through the spout assembly 40. As shown in FIG. 9, the pressure panel 82 can be pushed downwardly through the inner case member 62 to cause discharge of the contents of the bag-like container 22 through the spout body 42. When sufficient of the material has been discharged, the closure bracket 70 can be advanced from the dot-dash line position of FIG. 9 to the FIG. 13 position at which flow of the plastic material through the spout assembly 40 is shut off by the tongue 80.

The container illustrated in the drawings and described above is subject to structural modification without departing from the spirit and scope of the appended claims.

Having described our invention, what we claim as new and desire to secure by Letters Patent is:

1. A bag-like container which comprises a first flexible wall member, a second flexible wall member, means for attaching edge portions of the flexible wall members together to form a container, a spout having an annular body and an outstanding annular flange at an end of the body, the flange being attached to one of the wall members with the flanged end of the spout closed by the wall member, there being slot means in the annular body parallel to the annular flange and spaced therefrom, a closure plate member slideably mounted in the slot means, and a tongue mounted on the closure plate member, the tongue moving in openings in opposed sides of the spout body between a closed position in which the tongue closes the spout body and an open position whereby when an aperture is provided in the wall member through which the interior of the container is in communication with the interior of the spout, the tongue can be positioned to regulate discharge of contents of the container.

2. A container as in claim 1 in which the outstanding annular flange and the closure plate are supported by the spout to embrace opposite sides of a container supporting member received between the annular flange and the closure plate member.

3. A container as in claim 1 in which the body of the spout includes four sides arranged annularly, the slot means are disposed in opposed sides of the body of the spout, and the openings are disposed in other opposed sides of the body of the spout.

4. A bag-like container which comprises a flexible wall means forming an enclosed container proper, a spout having an annular body and an outstanding annular flange at an end of the body, the flange being attached to the wall means with the flanged end of the spout closed by the wall means, there being slot means in the annular body parallel to the annular flange and spaced therefrom, a closure plate member slideably mounted in the slot means, and a tongue mounted on the closure plate member, the tongue moving in openings in opposed sides of the spout body between a closed position in which the tongue closes the spout body and an open position whereby when an aperture is provided in the wall member through which the interior of the container is in communication with the interior of the spout, the tongue can be positioned to regulate discharge of contents of the container.

5. A bag-like container which comprises a flexible wall means forming a closed container, a spout having an annular body and an outstanding annular flange at an end of the body, the flange being attached to the wall means with the flanged end of the spout closed by the wall means, there being slot means in the annular body parallel to the annular flange and spaced therefrom, a closure plate member slideably mounted in the slot means, and a tongue mounted on the closure plate member, the tongue moving in openings in opposed sides of the spout body between a closed position in which the tongue closes the spout body and an open position, the outstanding annular flange and the closure plate are supported by the spout to embrace opposite sides of a container supporting member received between the annular flange and the closure plate member, whereby when an aperture is provided in the wall member through which the interior of the container is in communication with the interior of the spout, the tongue can be positioned to regulate discharge of contents of the container.

* * * * *